US005788533A

United States Patent [19]

Alvarado-Rodriguez

[11] Patent Number: 5,788,533

[45] Date of Patent: Aug. 4, 1998

[54] BALLAST SYSTEM FOR INTERCONNECTION WITH FLUORESCENT LAMPS AND THE LIKE

[76] Inventor: Baldemar Alvarado-Rodriguez, Av. Eugenio Garza Sada 6405 Col. Residencial La Hacienda 64890, Monterrey, N.L., Mexico

[21] Appl. No.: 707,288

[22] Filed: Sep. 3, 1996

[51] Int. Cl.[6] ..... H01R 4/26

[52] U.S. Cl. ..... 439/441; 439/239; 174/DIG. 2

[58] Field of Search ..... 439/438, 239; 174/DIG. 2

[56] References Cited

U.S. PATENT DOCUMENTS

| | | | |
|---|---|---|---|
| 2,702,378 | 2/1955 | Talty | 439/620 |
| 4,165,443 | 8/1979 | Figart et al. | 439/438 |
| 4,916,363 | 4/1990 | Burton et al. | 174/DIG. 2 |
| 5,006,764 | 4/1991 | Swanson et al. | 174/DIG. 2 |
| 5,148,086 | 9/1992 | Costa | 174/DIG. 2 |

*Primary Examiner*—P. Austin Bradley
*Assistant Examiner*—T. C. Patel
*Attorney, Agent, or Firm*—Laurence R. Brown

[57] ABSTRACT

The present invention relates to an improved system of interconnecting ballasts and fluorescent lights; more specifically, for a ballast whose circuit is duly insulated and housed in a casing, is fitted with prongs which are connected to the coil and capacitor by means of wires. One or more receptacles are provided into which the prongs are inserted. A protective cover over the receptacle(s) has a catch at one end into which is inserted a retaining clip to secure the cover in place. The ballast circuit has cable wires running from the receptacles,firmly mounted inside the casing , to the fluorescent lights.

4 Claims, 13 Drawing Sheets

BALLAST SYSTEM FOR INTERCONNECTION WITH FLUORESCENT LAMPS AND THE LIKE

FIELD OF THE INVENTION

The present invention relates to an improved system of interconnecting ballasts and fluorescent lights; more specifically, for a ballast whose circuit, duly insulated is housed in a casing which is fitted with prongs which are connected to the ballast coil and capacitor by means of wires and one or more receptacles into which prongs are to secure the cover in place for securing wiring from the fluorescent lights into the receptacles. The system has utility which secures it in place; and wiring running from the receptacles to the light fittings. The system corresponds principally to the field of lighting, and specifically to the illuminated sign industry.

BACKGROUND OF THE INVENTION

For many years now the lighting industry has relied on what are known as fluorescent lights; devices known as ballasts are indispensable in the corresponding electrical circuits to complete the lighting operation.

In this operation the ballast deteriorates slightly due to heating up which after a time results in the need for it to be replaced. Replacing represents a considerable investment of both time and money, taking into account that the mounting screws have to be removed and terminals have to be disconnected by hand, the new ballast then has to be remounted, the wires identified and reconnected, all of which represents a considerable loss of time and labor costs are incurred.

BRIEF DESCRIPTION OF THE INVENTION

This invention solves the aforementioned problem: by simply disengaging the receptacle cover retaining clip, remove the ballast and immediately installing a new one by inserting the connector prongs while avoiding the traditional loosening and tightening of screws and the disconnecting and re-connecting of wires and terminals.

The inclusion of push-in terminals into which the wire ends are inserted makes the disconnecting and re-connecting of wires much easier, thus improving devices known to date.

Also, incorporating this new device in existing systems would facilitate the work of those who install or replace a considerable number of ballasts in the circuits of a large illuminated sign. Using present methods and technology this task would take several days, whereas by using the device described in this application, the task would be reduced to a matter of hours.

These and other advantages may be derived from studying this description and the accompanying drawings.

DESCRIPTION OF THE. PREFERRED EMBODIMENT

Figure 1:
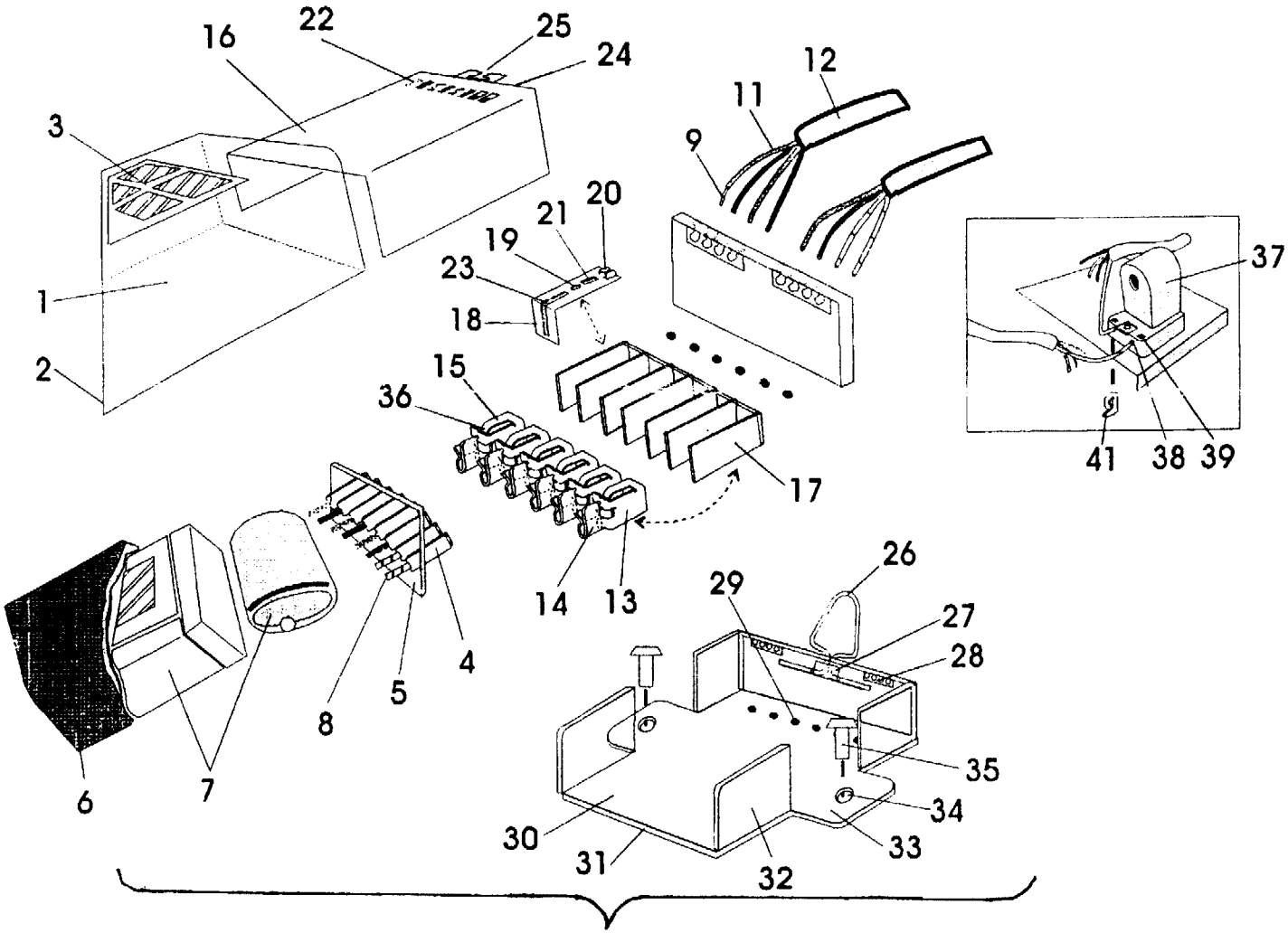
FIG. 1: Shows an exploded view of the ballast, the receptacle base plate, the receptacles, the interconnecting cable, and the light fitting.
Figure 2:
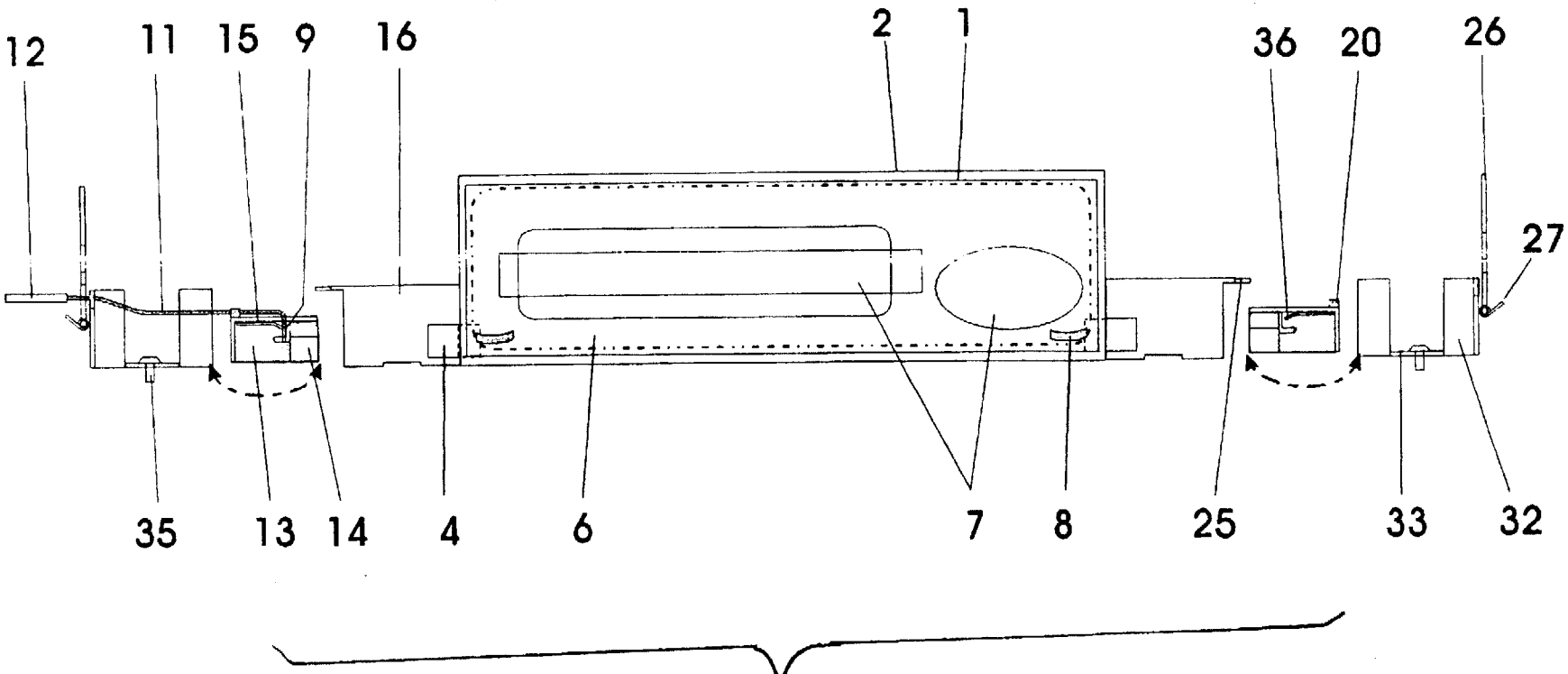
FIG. 2: Shows a view from the top of a longitudinal section of the ballast and two receptacle base plates, placed at each end.
Figure 3:
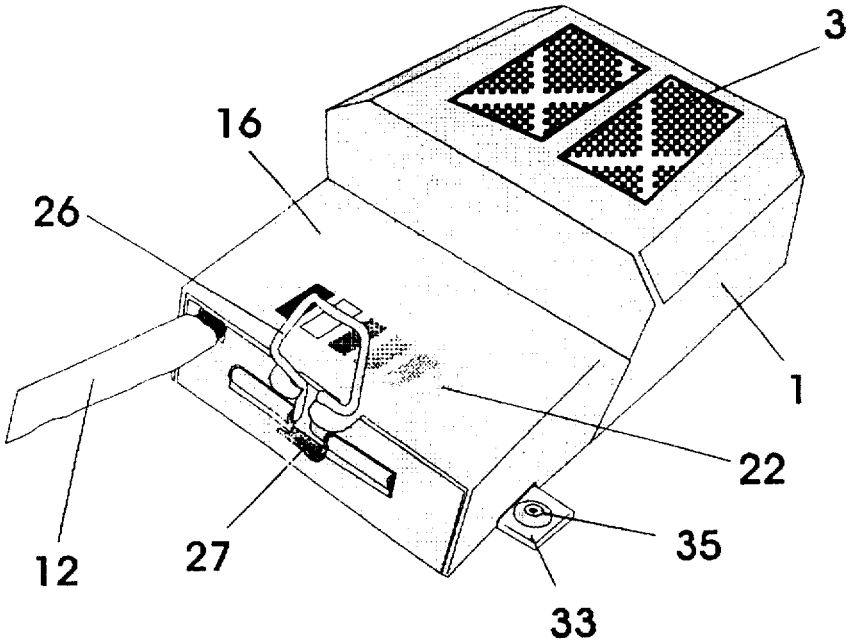
FIG. 3: Is a perspective view of the ballast clipped in place on the receptacle base plate.
Figure 4:
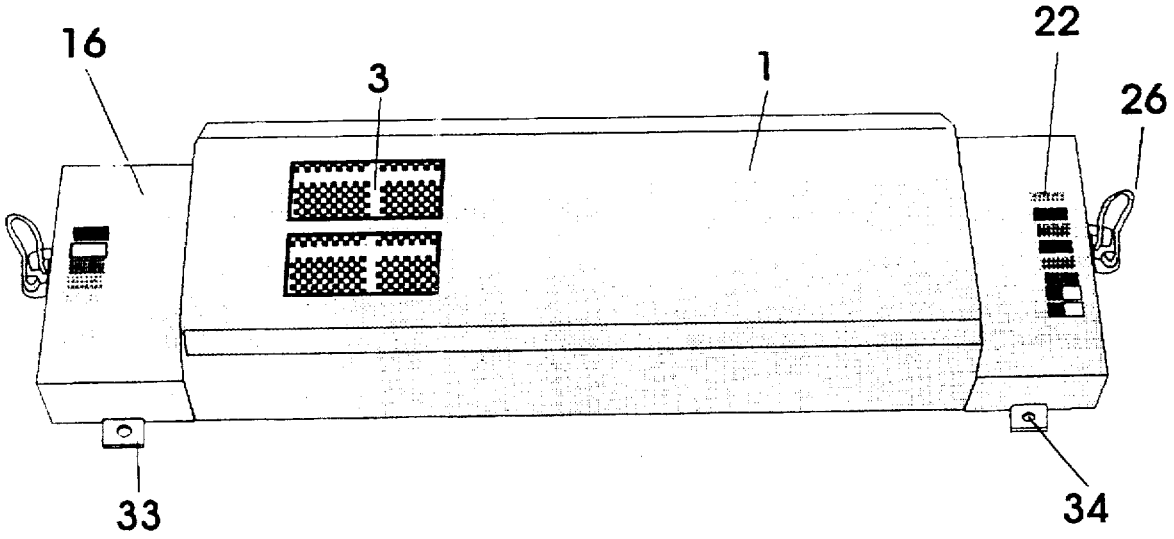
FIG. 4: Is a perspective exterior view of the ballast fixed at each end to the receptacle base plates; also showing the location of the wiring diagrams and the color coded guide for the exit wiring.
Figure 5:
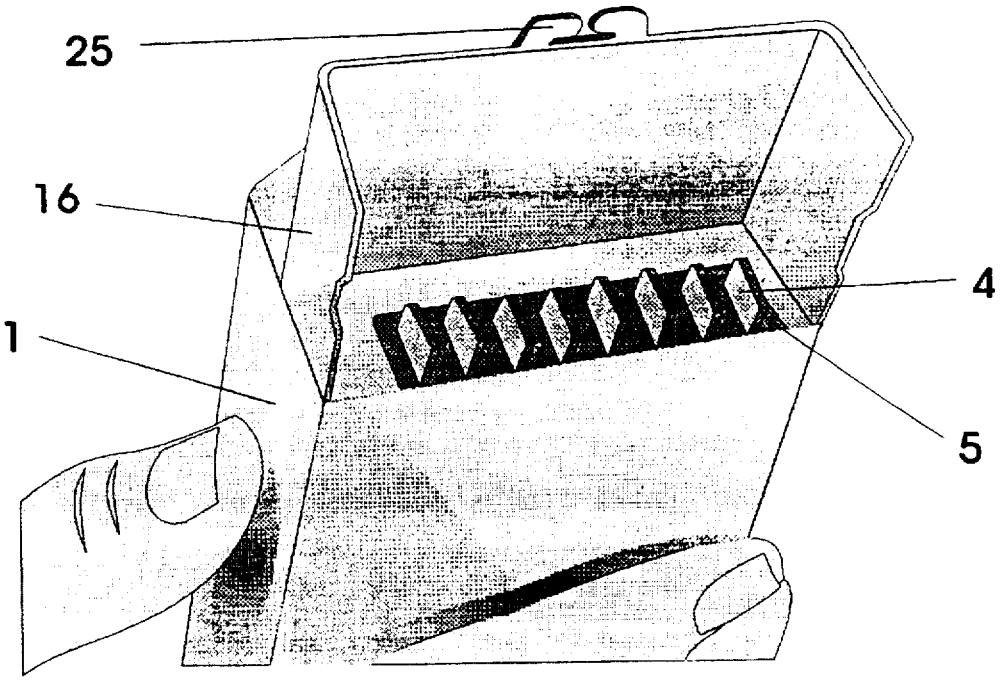
FIG. 5: Is an isometric view of the ballast.
Figure 6:
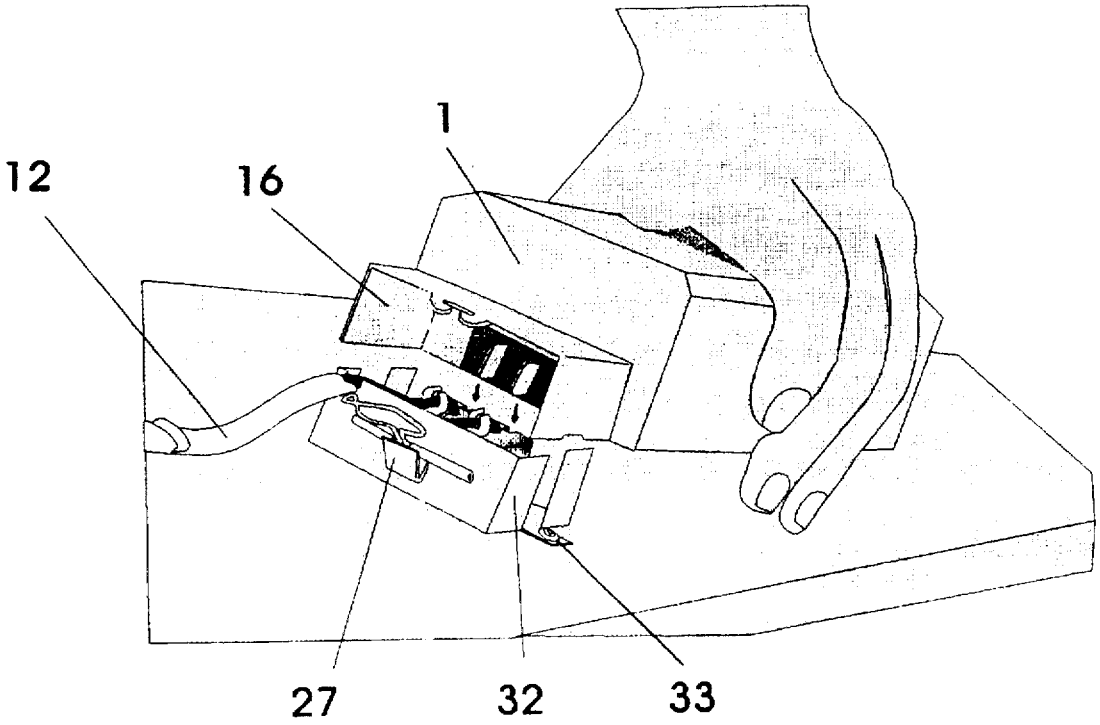
FIG. 6: Is a view showing how the ballast is mounted and dismounted.
Figure 7:
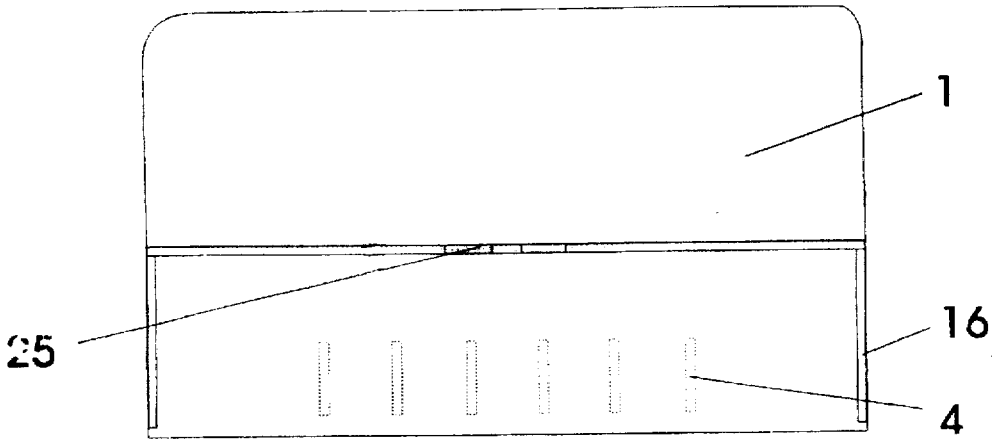
FIG. 7: Is a front view of the ballast.
Figure 8:
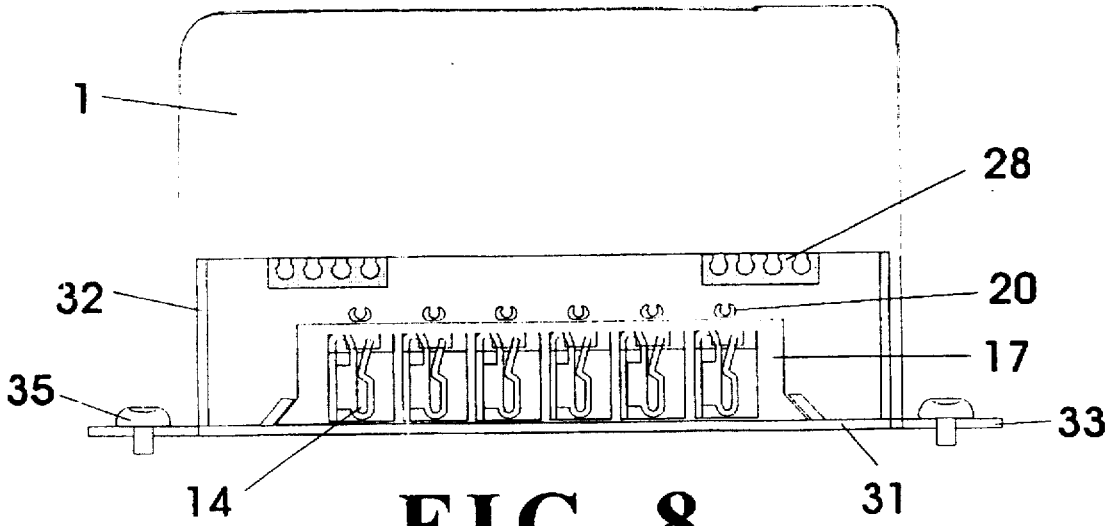
FIG. 8: Is a front view of the receptacle base plate.
Figure 9:
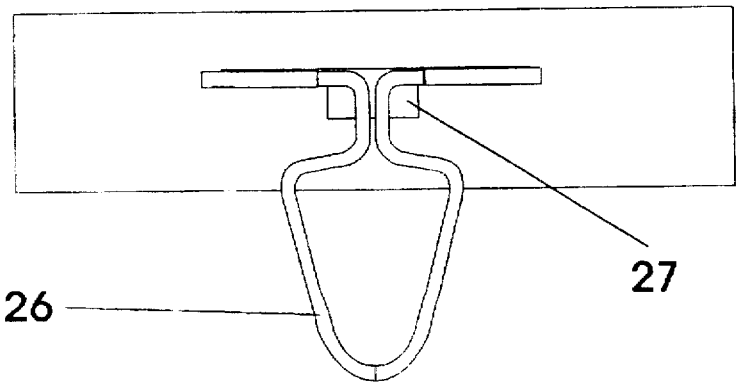
FIG. 9: Front of the receptacle base end and retaining clip.
Figure 10:
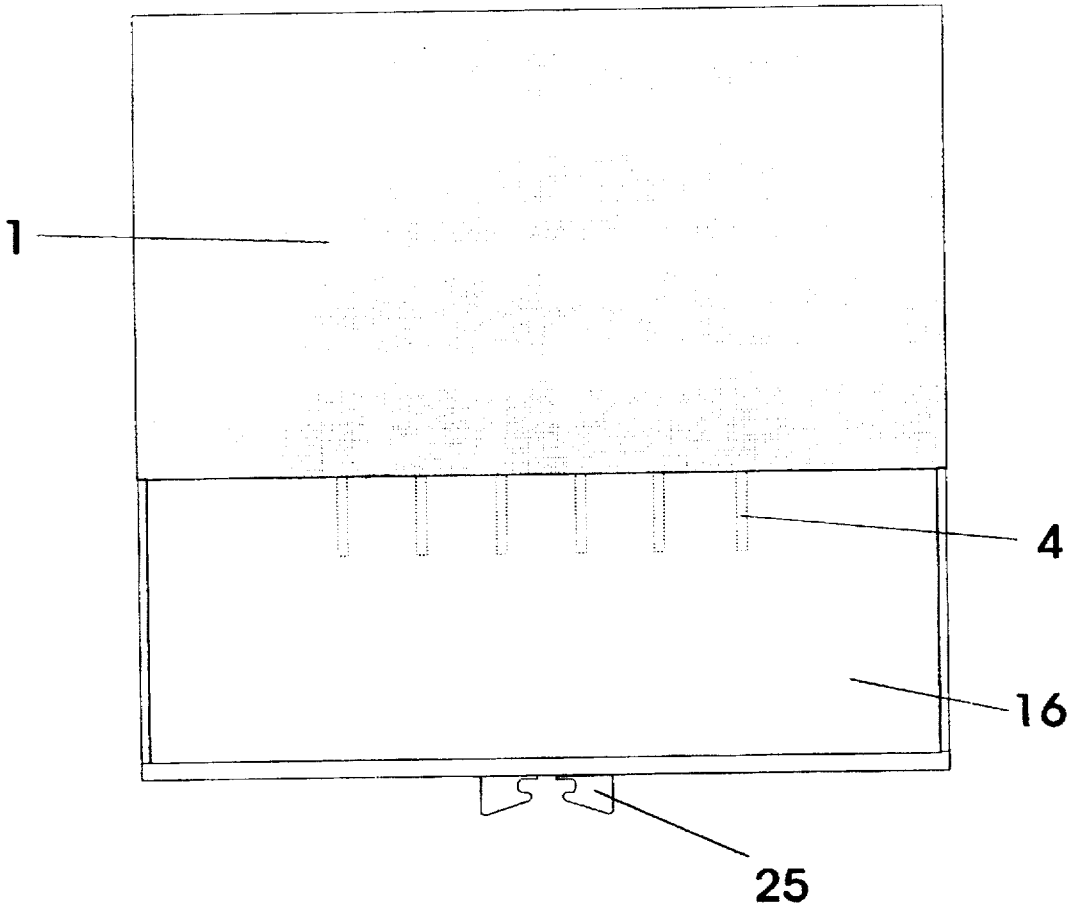
FIG. 10: Is a top view of the ballast.
Figure 11:
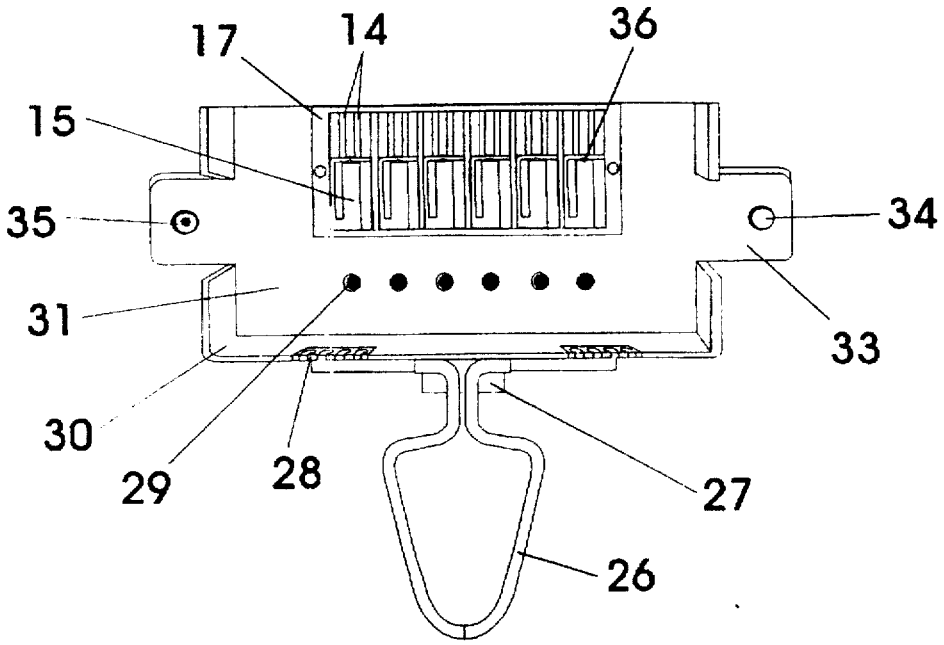
FIG. 11: Is a top view of the receptacle base plate.
Figure 12:
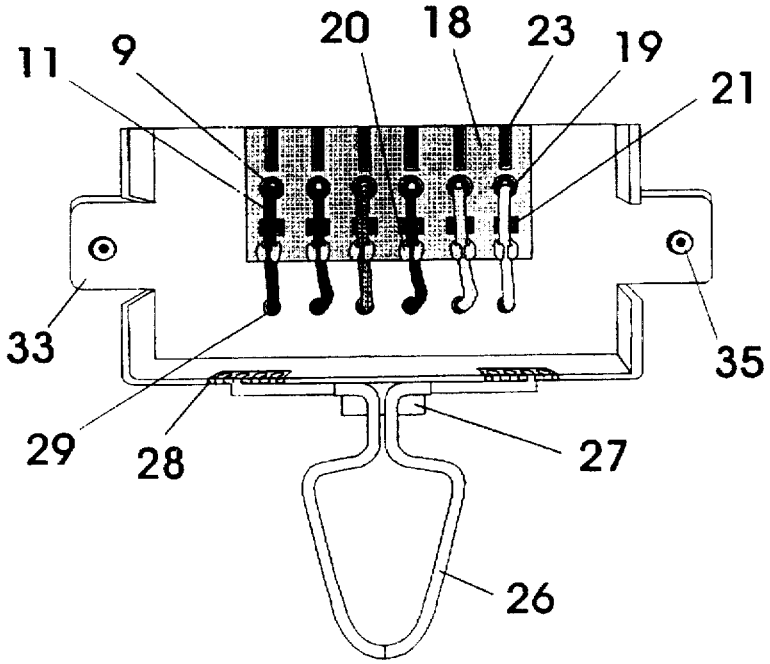
FIG. 12: Is a top view of the receptacle cover, showing the wiring paths.
Figure 13:
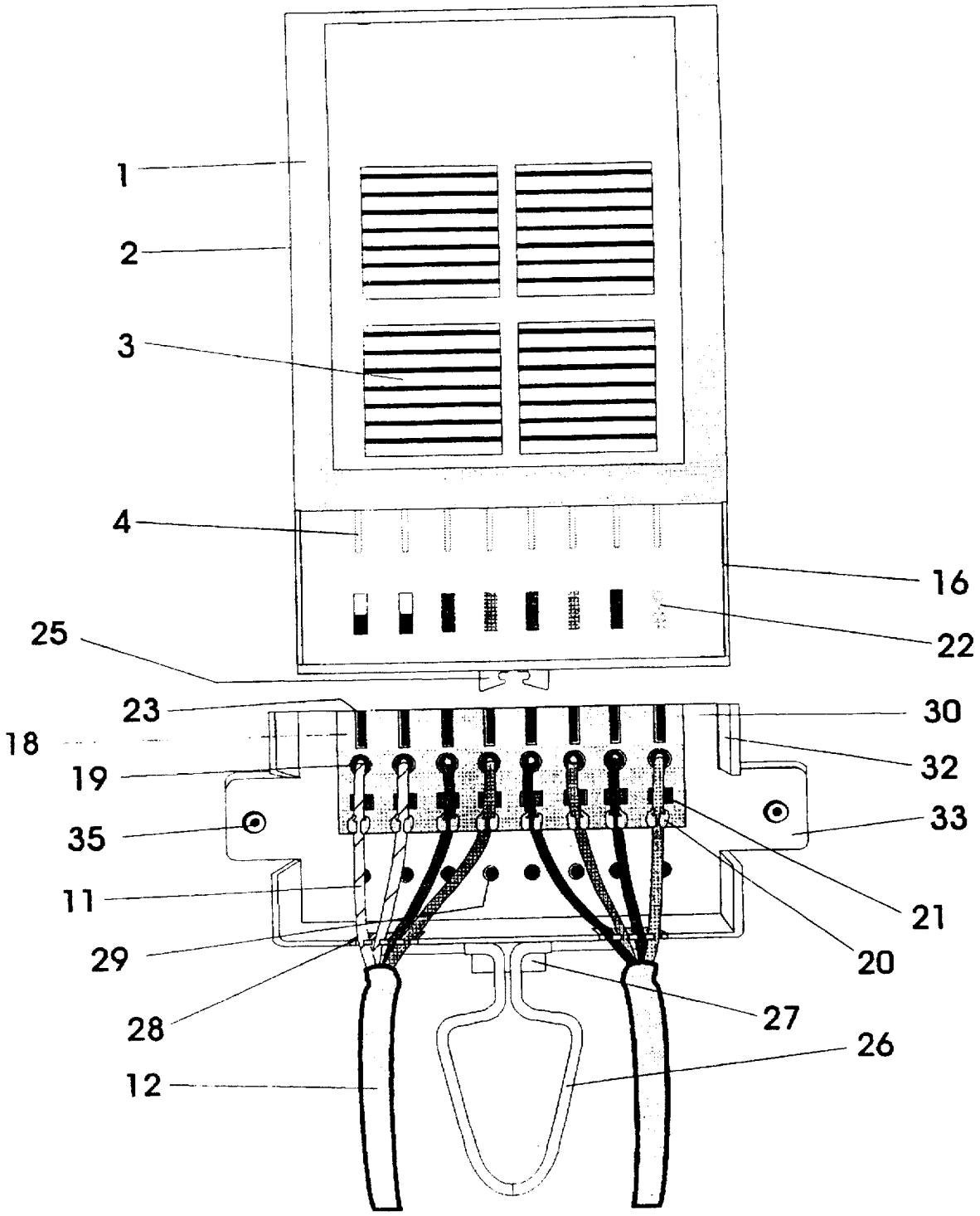
FIG. 13: Is a top view of the casing showing the wiring diagram labeling, the color coded wiring diagram, multi-contact receptacle, optional cable exits, wire clamps and the retaining clip.
Figure 14:
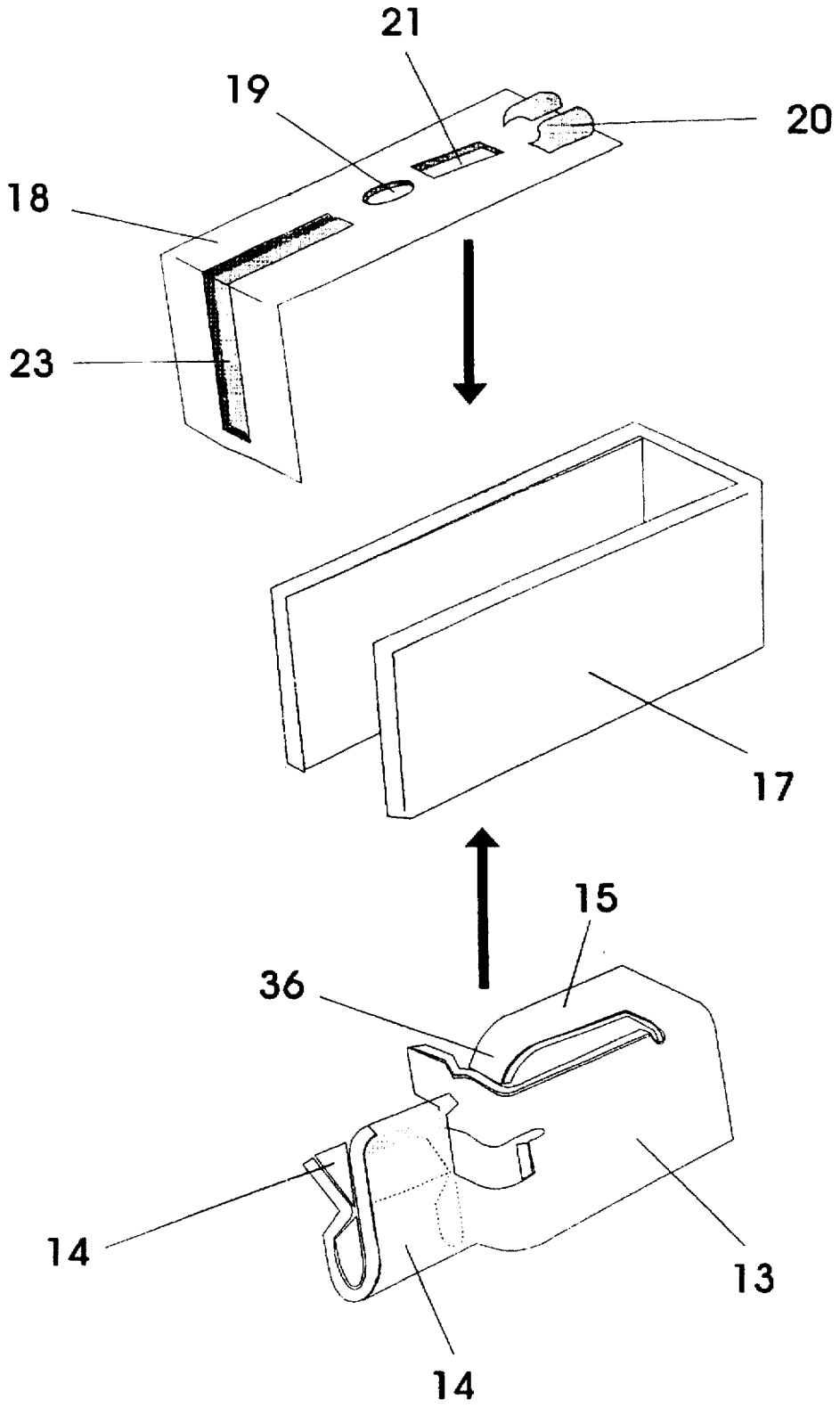
FIG. 14: Is an exploded view of a receptacle.
Figure 15:
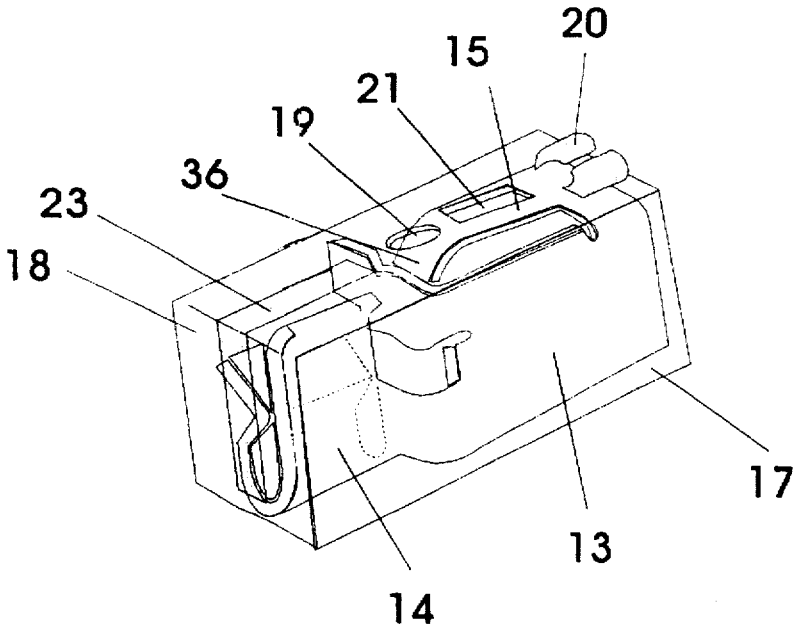
FIG. 15: Is an isometric view of a receptacle in its housing.
Figure 16:
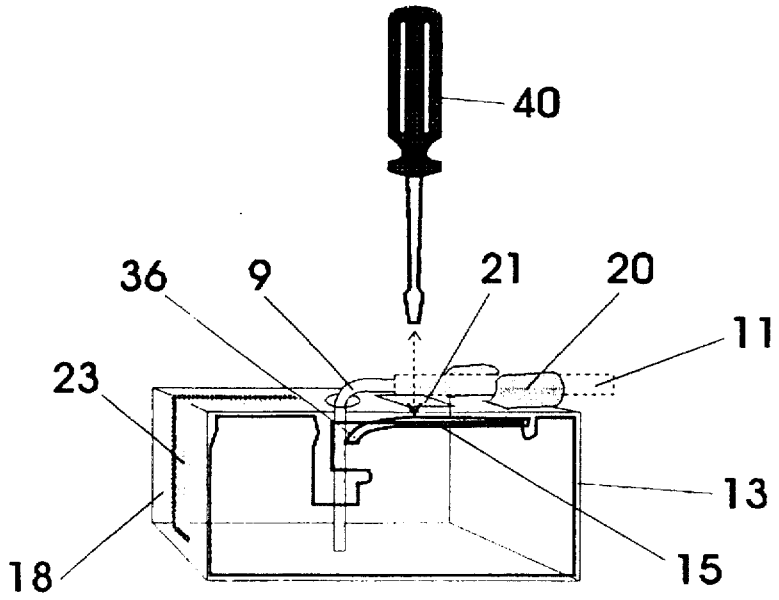
FIG. 16: Is a schematic view showing insertion of a screwdriver to depress a spring for releasing a wire end.
Figure 17:
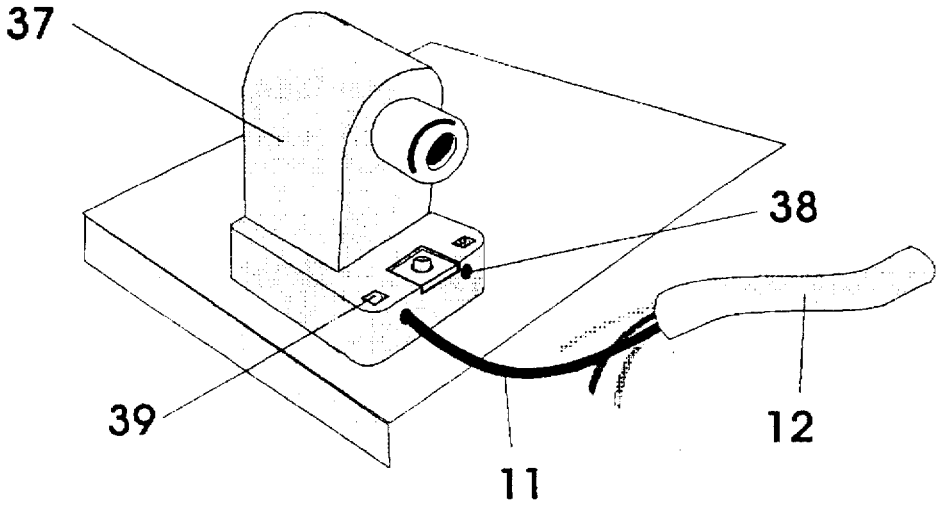
FIG. 17: Is a perspective view of light fitting.
Figure 18:
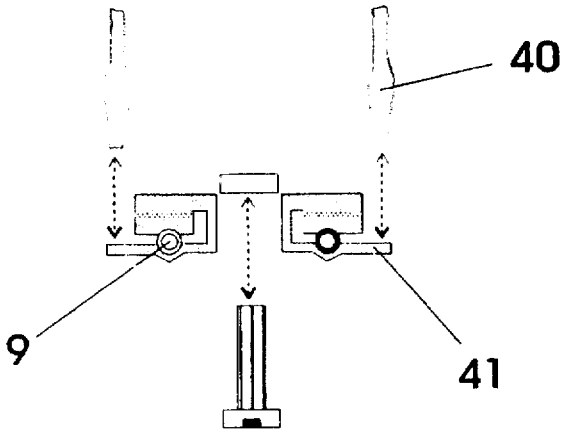
FIG. 18: Is a schematic view showing wire end trapped by a spring.
Figure 19:
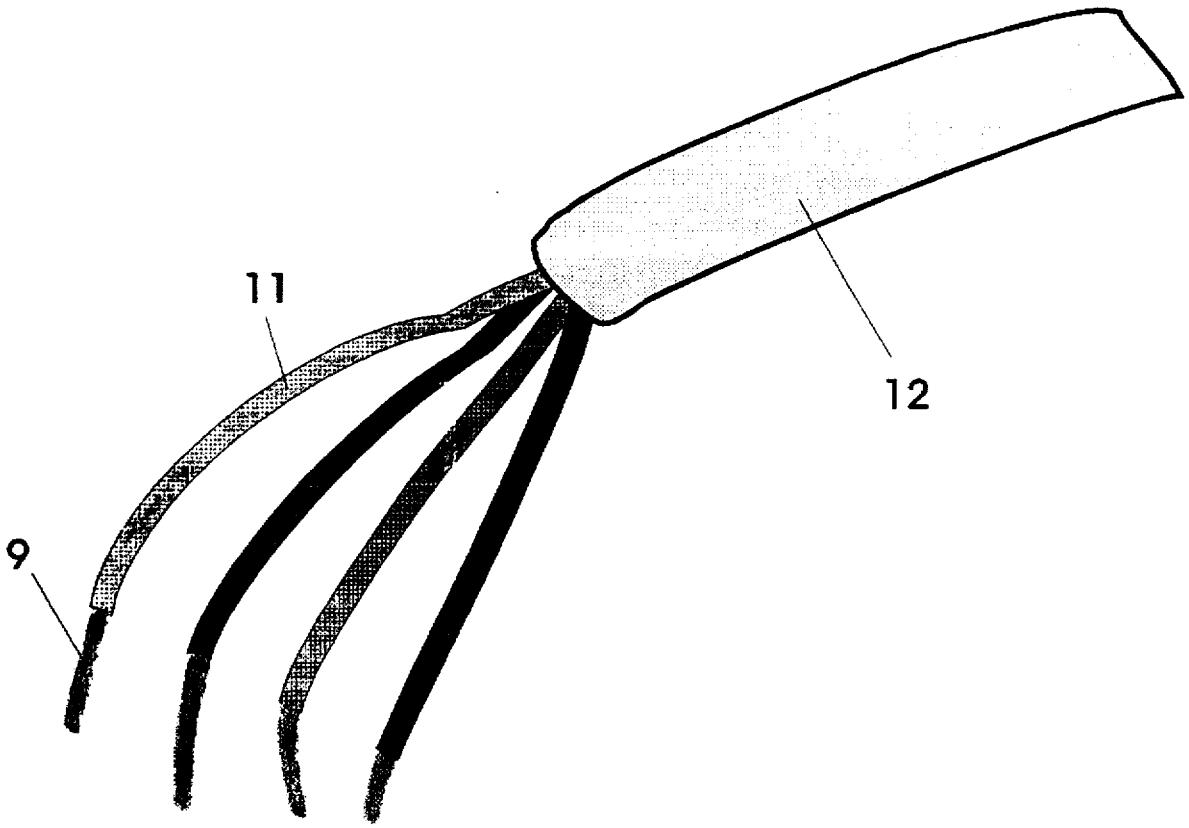
FIG. 19: Is a perspective view of a cable section.
Figure 20:
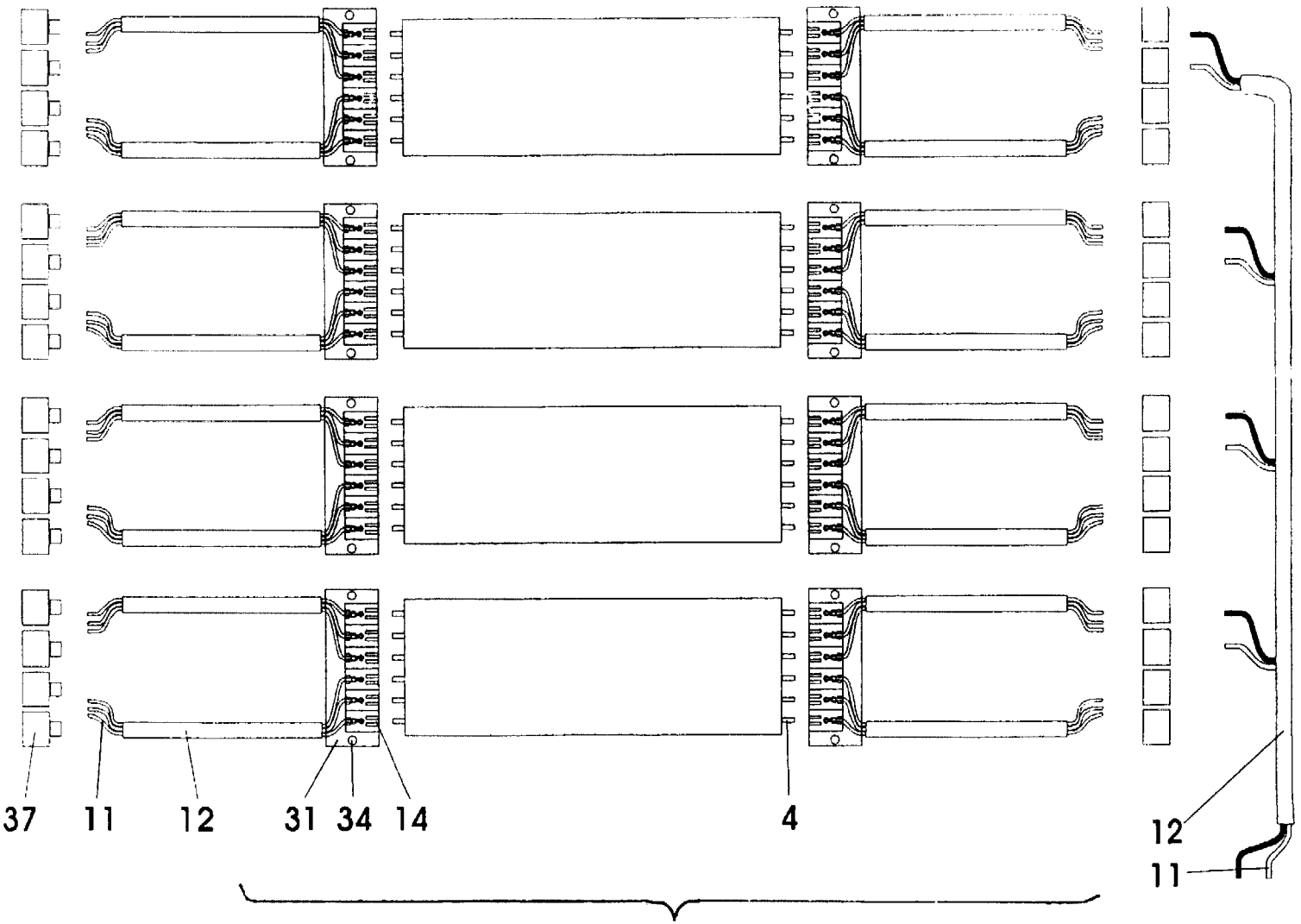
FIG. 20: Is a top view of several ballasts interconnected by means of the present invention.

With reference to the said drawings, the system comprises a combination of a ballast (1) whose circuit (7), which has an insulating cover (6), instead of being simply connected by wires (11), is fitted with fixed prongs (4) in one side of the insulating cover (5) which are connected to the circuit (7) by means of wires (8).

The ballast (1) also has a protective cover (16) with a color guide to identify the output wires (11). The cover forms an integral part of the casing (2), is labeled with a wiring diagram (3), and has a catch (25) at one end (24) by which it is firmly secured in place with the retaining clip (26) which is fitted with a stop (27) to prevent it from hanging loose and which forms part of the receptacle base plate (30). Thus, when it becomes necessary to remove the ballast from the receptacle base plate (30), all that has to be done is to disengage the clip (26) from the catch (25). The base plate (30) is held in place inside the protective cover (16); integral housing (17) holds the receptacles (13) in position.

The receptacles (13) are each fitted with push-in contacts (36) by which the ends (9) of the cables (11) are connected according to color, following the color coded diagram (22) on the protective cover (16) of the ballast (1). All that has to be done is to insert the end (9) of the wire (11) through the hole (19) in the said contact (36), which will trigger the spring (15) in the contact (36), and the wire end (9) will be securely held in the receptacle (13). If it is necessary to remove the wire end (9) the spring (15) is depressed by inserting a screwdriver (40) in the slot (21), which will release the end (9) of the wire (11).

The receptacle housing (17) cover (18) contains slots (23) for prongs (4) of the ballast (1) and a hole (19) through which the end (9) of wire (11) may be inserted and held in place by the push-in contact (36) in the receptacle (13).

The receptacle (13) housing (17) cover (18) has several wire clamps (20) to enable all wires (11) to be held firmly in place, whether they run through the side wire guides (28) in the receptacle base plate (30) or through the holes (29) in the bottom of the receptacle base plate (30).

The receptacle base (31) consists of a base plate (30) with perpendicular side walls (32) which support the protective cover (16) of the ballast (1), to guide the prongs (4) exactly into place in the receptacle (13) clips (14). The base plate is also fitted with lugs (33) to enable the receptacle base (30) to be mounted with rivets (35) or screws in the desired position, and also has holes to receive the wires (11) from below. Exit guides (28) pass the wires (11) through to the outside. Retaining clip (26) secures the ballast (1) and a stop (27) to prevents the clip (26) from hanging loose.

The receptacles (13) are mounted on the base plate (30), held at the sides by the housing (17), covered with a cover (18) and thus are held in position. The receptacles (13) are made of a relatively flexible material as are the clips (14) which receive the prongs (4) and hold them firmly in place in such a way that, due to the conductive properties of the prongs and receptacles, conduction takes place in an effective and continuous fashion.

The system has a special cable (12) containing multiple wires (11) in a single sheath, each of which may be identified by its colored insulation. In this way, a single cable runs to the lamp sockets connected according to the diagram (3) on the label on the ballast(1) casing (2), instead of having a confusion of loose wires running all over the installation.

The system is also fitted with a light fitting (37) which is in turn fitted with a push-in contact (38) on the front and a slot (39) which together with a secondary spring (41) enables the wire (11) ends (9) to be inserted and released by means of a screwdriver which when inserted in the slot depresses the spring (41) and allows the wire end (9) to be removed.

What I claim is:

1. A ballast housing system for removable plug in connection of a ballast to lead wires extending from a fluorescent light, comprising in combination:

a ballast having a ballast circuit and a ballast housing, connecting wires leading from the ballast circuit having prongs arranged in a set for removably plugging the ballast into operative position inside the ballast housing, a protective insulating ballast housing cover removably affixed on the housing to permit insertion and removal of said ballast into said housing, a wire and prong receiving receptacle mounted securely on the inside of the housing and having affixed thereon an array of spring biased wire receiving contact members for removably receiving and holding in place both said set of ballast prongs and individual bare wire ends of said fluorescent light lead wires to make an electrical connection between the fluorescent light and said ballast circuit, and entryways into the housing for passing the fluorescent light lead wires inside for spring biased retention of bare lead wire ends in said receptacle in electrical contact with the ballast circuit.

2. The ballast housing system of claim 1, further comprising color coding on said fluorescent light lead wires and said housing to identify respective entryways for passing the lead wires inside the housing.

3. The ballast housing system of claim 1 wherein said cover is removed vertically to expose the ballast in position for vertical removal from the housing, and wherein said receptacle further comprises contact members for receiving the set of ballast prongs oriented to frictionally permit vertical removal and insertion of the ballast prongs into the receptacle.

4. The ballast housing system of claim 1 further comprising housing and cover members for seating the ballast removably in place inside the housing for retention in place solely by the receptacle member spring biased contact members.

* * * * *